United States Patent [19]

Nissen

[11] 4,244,429

[45] Jan. 13, 1981

[54] MOUNTING MECHANISM FOR ANGLE DOZER BLADE

[75] Inventor: Roland N. Nissen, Wichita, Kans.

[73] Assignee: J. I. Case Company, Racine, Wis.

[21] Appl. No.: 950,593

[22] Filed: Oct. 12, 1978

[51] Int. Cl.[3] ..... E02F 3/76

[52] U.S. Cl. ..... 172/804; 172/809

[58] Field of Search ..... 172/807, 803, 809, 805, 172/801, 806, 808

[56] References Cited

U.S. PATENT DOCUMENTS

| | | | |
|---|---|---|---|
| 2,565,337 | 8/1951 | Allan | 172/804 |
| 3,226,860 | 1/1966 | McGee | 172/806 |
| 3,234,670 | 2/1966 | Fryer | 172/803 |
| 3,590,929 | 7/1971 | Wirt | 172/807 |
| 3,592,273 | 7/1971 | Martin | 172/807 |
| 3,759,110 | 9/1973 | Davis | 172/805 |

*Primary Examiner*—Richard J. Johnson

*Attorney, Agent, or Firm*—Dressler, Goldsmith, Shore, Sutker & Milnamow, Ltd.

[57] ABSTRACT

A dozer blade mounting for a dozer frame having a dozer blade movably supported thereon includes at least one rigid link that has one end pivoted on the vehicle frame and the opposite end pivoted on the dozer frame with fluid ram means associated with the vehicle frame and dozer frame for raising and lowering the blade and dozer frame and angling the dozer frame and blade with respect to a horizontal reference plane. In one version of the invention, two separate links are universally connected at opposite ends to the dozer frame and the vehicle frame and a pair of independently actuated fluid rams are interposed between the dozer frame and the vehicle frame to produce the raising and lowering as well as the tilting of the blade with respect to the vehicle. In another version, the rigid link is raised and lowered through a fluid ram between the link and the vehicle frame and a second fluid ram is interposed between the link and the dozer frame to produce the tilting of the blade.

6 Claims, 3 Drawing Figures

MOUNTING MECHANISM FOR ANGLE DOZER BLADE

BACKGROUND OF THE INVENTION

The present invention is directed to an improvement in blade mounting assemblies and more particularly to an improved mounting assembly for mounting a dozer frame which supports a dozer blade of the type disclosed in Davis U.S. Pat. No. 3,759,110, assigned to the assignee of the present invention.

Numerous proposals have been made for supporting a dozer blade on a vehicle which permits varied motion of the blade, for example, raising and lowering, tilting, and angling the blade with respect to predetermined reference planes.

In the arrangement disclosed in the Davis patent, the mounting frame for the dozer blade is supported on a vertical column which is fixed to the vehicle frame and is shiftable along the vertical column through a fluid ram to raise and lower the blade with respect to the ground. While such an arrangement is acceptable, it requires that the mounting frame be located sufficiently rearwardly so as to be clear of the wheels when the frame is in a raised condition.

The above mentioned patent also discloses a unique manner of supporting a dozer blade on a dozer frame which is capable of automatically shifting the blade laterally as well as angling the blade with respect to the longitudinal axis of the vehicle. The blade can also be shifted away from the vehicle. The structure disclosed in the Davis patent has been used successfully on a commercial basis for sometime. However, in order to increase the versatility of such a unit, it is also desirable to be capable of tilting the blade with respect to a horizontal reference plane.

SUMMARY OF THE INVENTION

According to the present invention, a mounting structure for a dozer frame that has a dozer blade movably supported thereon includes a simple structure which is capable of raising and lowering the blade in a closely confined area adjacent the vehicle wheels and also tilting the blade with respect to a horizontal reference plane.

The mounting structure of the present invention includes at least one link that has one end pivoted on the vehicle frame and the opposite end pivoted on the dozer frame with fluid ram means interposed between the vehicle frame and the dozer frame for both raising and lowering the dozer blade as well as tilting the dozer blade with respect to the horizontal reference plane.

In one embodiment of the invention, the linkage means includes first and second transversely spaced lower links that are connected by universal connections at one end to the vehicle frame and through further universal connections to the mounting frame and a single upper link. A pair of independently actuated fluid rams are located between the mounting frame and the vehicle which can be extended and retracted simultaneously to raise and lower the blade and independently extended and retracted to tilt the blade with respect to a horizontal reference plane. In this version of the invention, the mounting mechanism also incorporates limiting means for limiting the amount of tilt of the mounting frame and dozer blade with respect to the horizontal reference plane. The limiting means also prevents transverse shifting of the blade with respect to the longitudinal axis for the vehicle.

In another version of the invention, the rigid link consists of a pair of transversely spaced arms that are pivoted on the vehicle frame and are interconnected at their free end with the mounting frame supported on a horizontal pivot axis on the rigid interconnecting member. A first fluid ram is interposed between the vehicle frame and the rigid link to pivot the link on the vehicle frame so that the mounting frame and the dozer blade are pivoted as a unit with the link between raised and lowered position. A second fluid ram is interposed between the link and the mounting frame to pivot the mounting frame and the dozer blade as a unit about the horizontal pivot axis to tilt the blade.

In both embodiments of the invention, the mounting frame is also specifically designed so that the pair of fluid rams that are utilized for angling and laterally shifting the blade on the mounting frame are located generally within the confines of the frame to reduce the amount of space required for the entire mounting structure. More specifically, the mounting frame consists of at least three vertically spaced plates with first and second arms pivoted at one end on the plates and the blade pivotally supported on the opposite ends of the arms with separate fluid ram cylinder and piston rod assemblies between the respective arms and mounting frame. One fluid ram is interposed between a pair of adjacent plates while the second fluid ram is interposed between another pair of adjacent plates so that fluid rams are located substantially within the confines of the frame structure at all times and extend generally transversely of the longitudinal axis for the vehicle.

DETAILED DESCRIPTION

Figure 1:
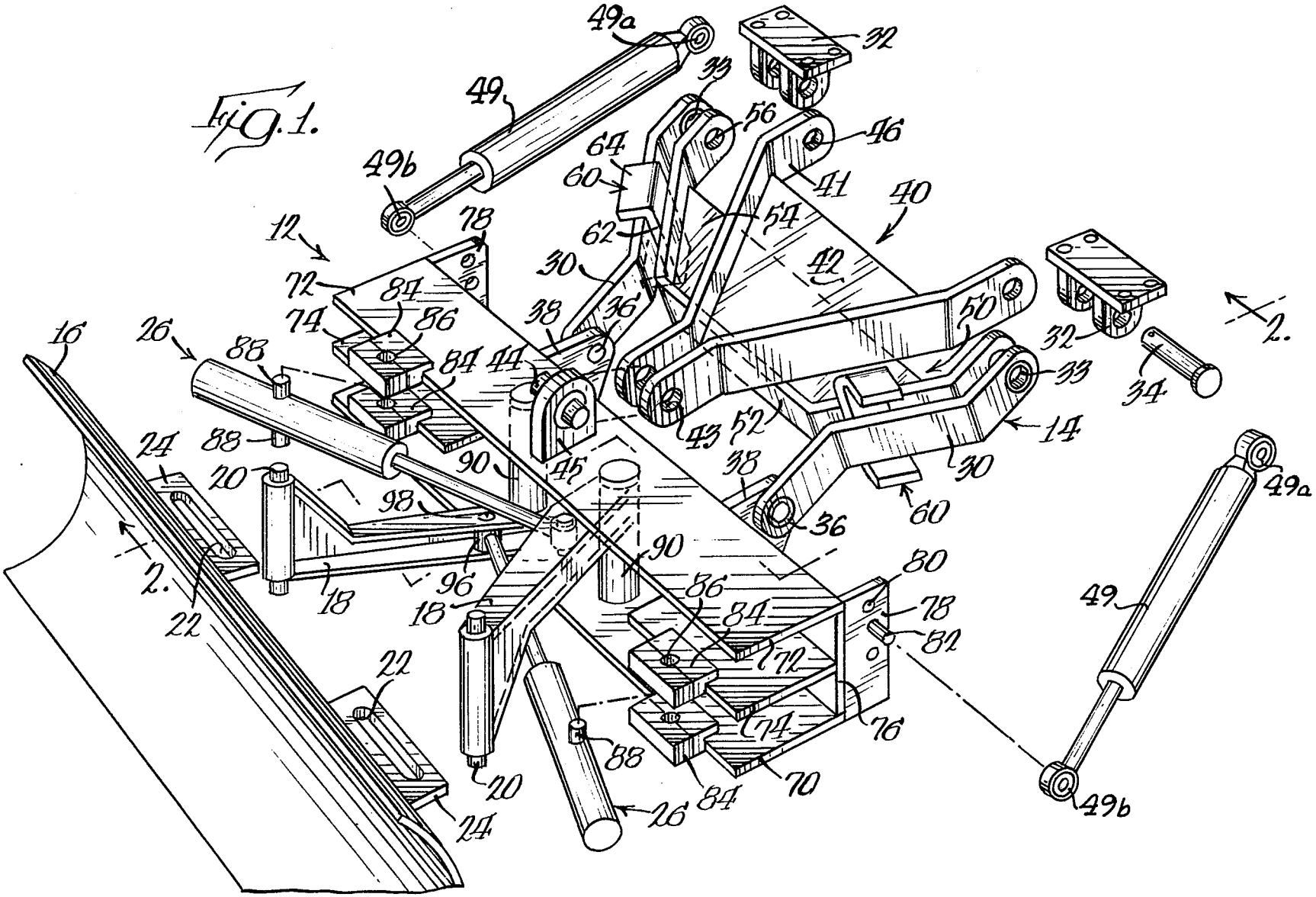
FIG. 1 discloses an exploded perspective view of the mounting arrangement for a dozer blade on a vehicle frame.

While this invention is susceptible of embodiment in many different forms, there is shown in the drawings and will herein be described in detail preferred embodiments of the invention with the understanding that the present disclosure is to be considered as an exemplification of the principles of the invention and is not intended to limit the invention to the embodiments illustrated.

Figure 2:
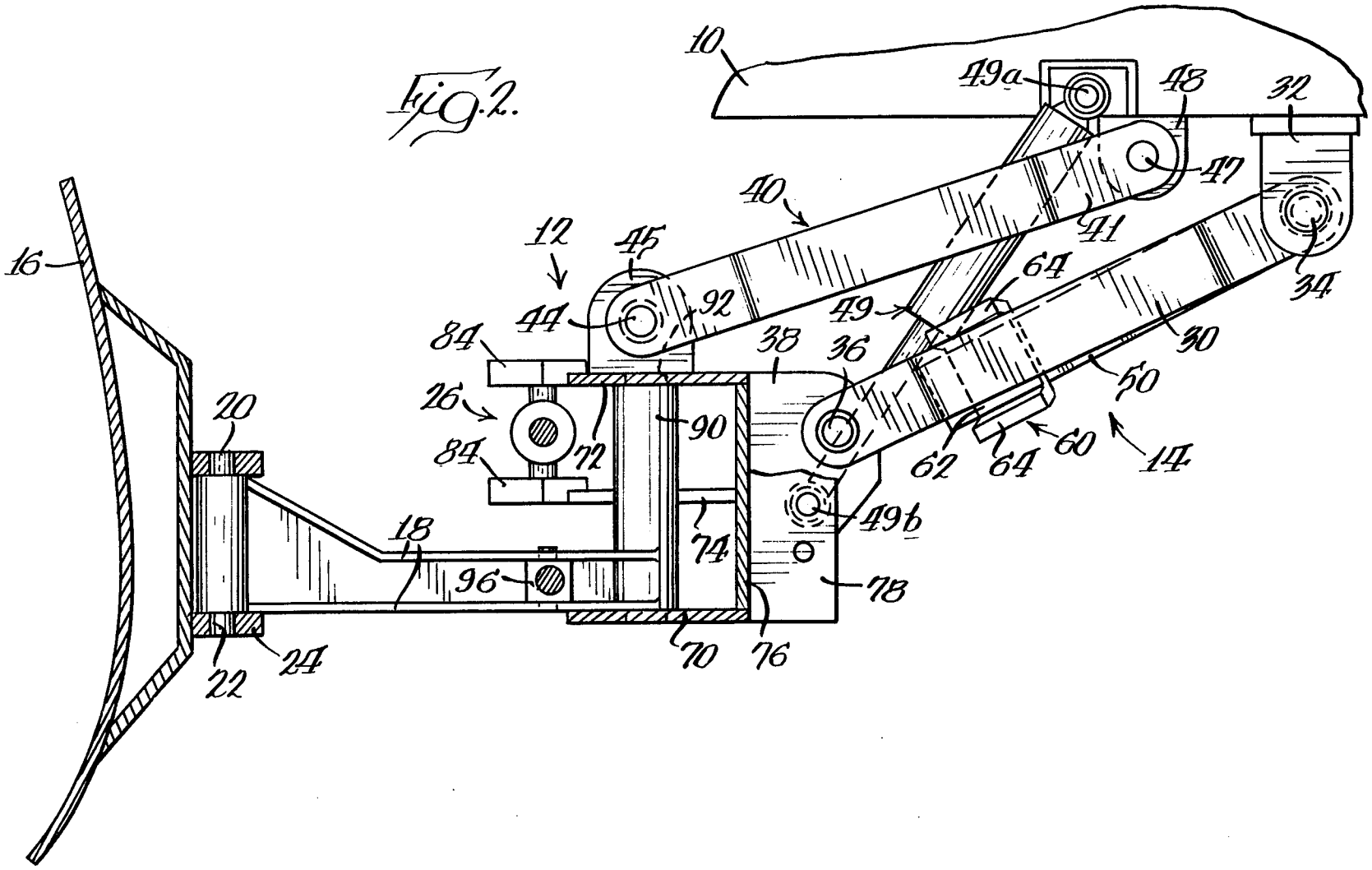
FIG. 2 is a vertical sectional view as viewed generally along line 2—2 of FIG. 1 showing the various components in assembled condition.

FIGS. 1 and 2 of the drawings generally disclose a vehicle having a vehicle frame 10 (FIG. 2) with a mounting frame 12 supported on vehicle frame 10 through linkage means 14 constructed in accordance with the present invention. Mounting frame 12 supports a dozer blade 16 and dozer blade 16 is supported on mounting frame 12 through first and second arm means 18 which have one end pivoted on mounting frame 12 and opposite free ends. The free ends of arms 18 have pins 20 which are received into elongated slots 22 that are defined in brackets 24. Arms 18 are moved on mounting or dozer frame 12 through a pair of identical fluid rams 26 which are mounted in a manner which will be described in more detail later.

According to the primary aspect of the present invention, mounting frame 12 is mounted on vehicle frame 10 through a mounting arrangement that is capable of raising and lowering dozer frame 12 and blade 16 as a unit and also tilting dozer frame 12 and blade 16 as a unit with respect to a horizontal reference plane. This mounting mechanism or linkage means 14 is most clearly illustrated in FIG. 1 and includes first and second transversely spaced lower links 30 which are identical in shape and configuration. One end of each link is connected to a bracket 32 through a well known universal connection 33 that is supported on a pin 34. The opposite end of each link 30 is also connected by a universal connection 36 to an ear 38 that is integral with the rear end of dozer frame 12.

A single upper link 40 is also located between mounting frame 12 and vehicle frame 10. Upper link 40 includes a pair of identical members or arms 41 which are interconnected by a gusset plate 42 and cooperate to define a generally A-shaped link. The apex of the generally A-shaped link has a pair of openings 43 which receive pin 44 of a ball joint that is supported in bracket 45 welded to frame 12. The respective legs of A-shaped link 40 have openings 46 which receive pins 47 (FIG. 2) supported on brackets 48 on frame 10.

First and second identical fluid rams 49 are interposed between the mounting or dozer frame 12 and vehicle frame 10. Each fluid ram or cylinder and piston rod assembly 49 has one end connected through a universal connection **49*a* to vehicle frame 10 and an opposite end connected to mounting frame 12 through a second universal connection 49*b*. Thus, simultaneous extension and retraction of both fluid rams 49, which are independently actuated through means not shown, will raise and lower mounting frame 12 and blade 16 as a unit along with links 30 and 40 as the links are pivoted about pivot pins 34 and 48. Tilting of blade 16 is accomplished through independent extension or retraction of one of the fluid rams or extension of one fluid ram and retraction of the other fluid ram 49 so that mounting frame 12 and dozer blade 16** tilt as a unit with respect to a horizontal reference plane.

According to one aspect of this invention, mounting mechanism 14 also incorporates limiting means 50 interposed between links 30 for limiting the amount of tilt that can be produced on blade 16 with respect to a horizontal reference plane and also limits transverse shifting of the blade and mounting frame with respect to a longitudinal axis for the vehicle. Limiting means or frame 50 consists of a substantially C-shaped rigid member 52 which is rigidified through a gusset plate 54 and is located between links 30. The free ends of C-shaped member 52 have openings 56 which receive pins 34 so that limiting frame 50 is pivotally supported on vehicle frame 10.

Limiting frame 50 also has a pair of motion control members 60 which are fixedly secured to C-shaped member 52 and are located in the path of movement of the first and second links 30. Each motion control member consists of a substantially C-shaped bar which has a web portion 62 secured to member 52 as by welding and has a pair of legs 64 extending therefrom with the legs 64 respectively located above and below link 30.

As illustrated in FIG. 1, the limiting frame 50 spans virtually the entire area between the first and second links 30. Thus, in operation, during normal raising and lowering and operation of dozer blade 16, limiting frame 50 prevents any undue lateral shifting of the dozer blade 16 and dozer frame 12 with respect to the longitudinal axis of the vehicle since any lateral shifting in either direction from a normally centered position will cause one of the links 30 to engage the web portion 62 of motion control member 60. At the same time, motion control members 60 limit the amount of tilt that can be produced by having one link 30 engage a lower leg 64 of one control member and the other link 30 engages the upper leg 64 of the second member.

With the above-described arrangement, an extremely simple mechanism, which pivots with links 30 is capable of limiting the tilt of the blade to a desired maximum and at the same time limits the transverse shifting of the universally mounted links 30 and the mounting frame 12 with respect to vehicle frame 10.

According to another aspect of the invention, the fluid rams 26 are mounted in a unique fashion so as to be substantially enclosed within the confines of mounting frame 12, particularly when the blade is in a transport position. For this purpose, mounting frame 12 consists of a lower plate 70, an upper plate 72 and an intermediate plate 74 which are vertically spaced from each other. Upper, lower and intermediate plates are interconnected by a vertical plate 76 which extends across the entire transverse dimensions of mounting frame 12 and has the mounting ears 38 fixedly secured thereto as by welding. Mounting plate 76 also has a pair of extensions 78 which are located on the exposed surface and extend towards the frame structure for the vehicle. These plates or extensions 78 may have a plurality of vertically spaced openings 80 for receiving the pins 82 which mount fluid rams 49 on mounting frame 12. The vertically spaced openings on each extension 78 will allow for adjustment of the raised and lowered position for mounting frame 12 and blade 16 when fluid rams 49 are in their fully extended or fully retracted positions.

As illustrated more clearly in FIG. 1, plates 72 and 74 have short extensions 84 extending therefrom with openings 86 which are adapted to receive trunnion pins 88 located on an intermediate portion of the cylinder of fluid ram 26. Likewise, the second fluid ram 26 is mounted between extensions 84 on intermediate plate 74 and lower plate 70 and again have openings 86 for receiving trunnion pins 88.

In the specific embodiment illustrated, intermediate plate 74 is in the form of two separate plates located on opposite ends so that the center portion between upper and lower plates 72 and 70 is open for receiving columns 90 that are mounted on one end of each arm 18 and are pivotally supported by pins 92. Of course, the piston rods of fluid rams 26 are mounted on intermediate portions of arms 18 through a sleeve 96 and a pin 98.

With this arrangement, and with a trunnion mounted cylinder, the entire fluid ram 26 can be located within opposite edges of mounting frame 12, and is at all times protected from debris and other materials by the upper and lower plates. It will be appreciated that while extensions 84 have been illustrated as being welded to plates 70, 72 and 74, such extensions could readily be an integral part of the plates, in which case the fluid rams would be mounted between adjacent pairs of plates before the plates are welded to the vertical rigidifying member or plate 76.

A slightly modified form of the invention is illustrated in FIG. 3 which again provides for raising, lowering and tilting the mounting frame and the blade with respect to the vehicle. In this embodiment of the invention, mounting frame 12 and blade 16 with the support mechanism between the two is identical to that described in connection with the previous embodiment so that a repetition of such description does not appear to be necessary.

Figure 3:
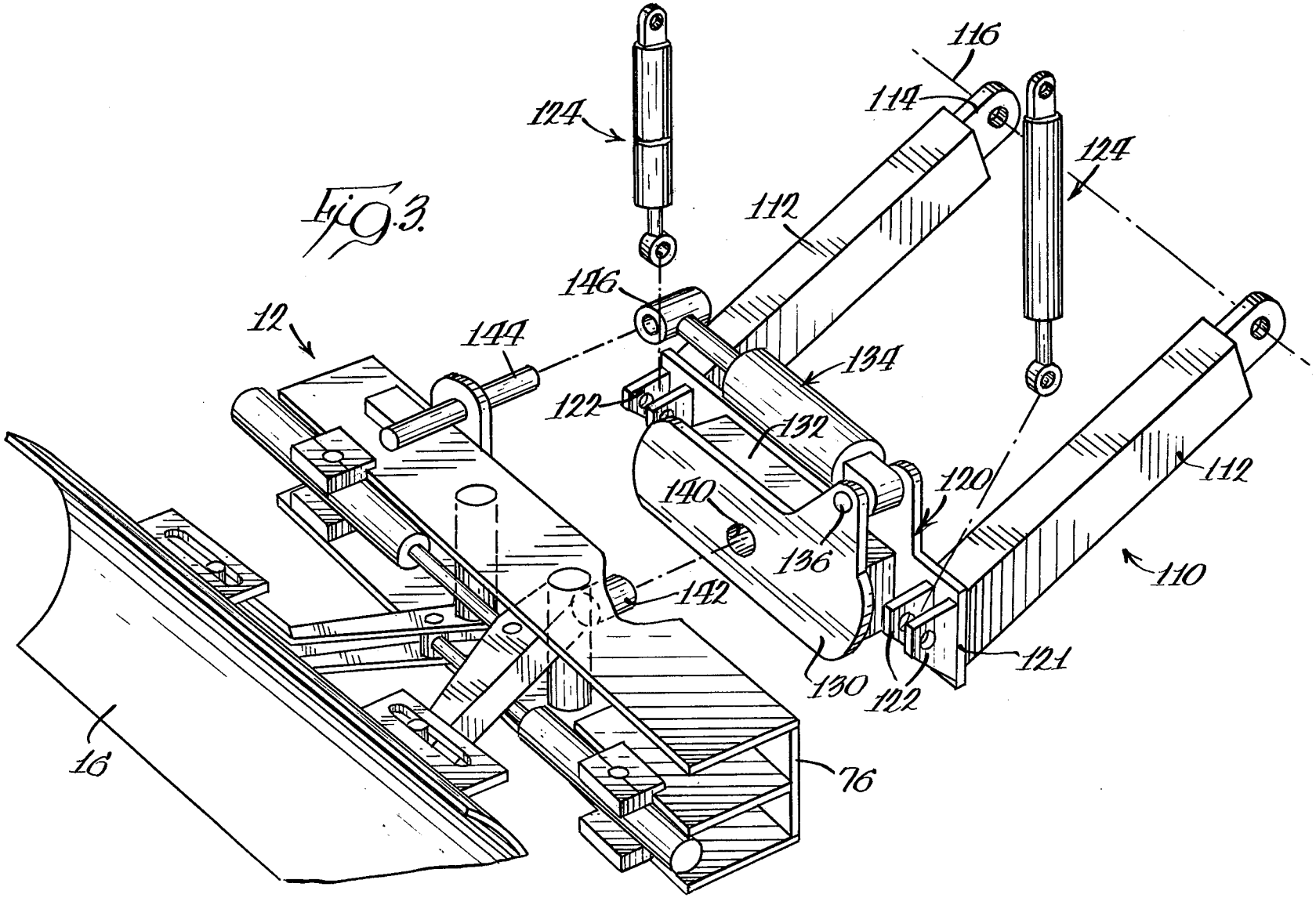
FIG. 3 is a modified form of mounting arrangement for the dozer blade.

In the embodiment illustrated in FIG. 3, the mounting mechanism for supporting mounting frame 12 on vehicle frame 10 includes a single rigid link 110 interposed between vehicle frame 10 and mounting frame 12. Rigid link 110 is in the form of a pair of transversely spaced arms 112 which have mounting members 114 at one end thereof that are pivotally mounted on a generally horizontal, transverse pivot axis 116 defined on frame 10. The outer free ends of arms 112 are interconnected by a rigid member 120 which includes a plate 121 that is preferably welded to the free ends of arms 112. Rigid member 120 has a pair of mounting ears 122 at each end thereof for pivotally supporting one end of each of the pair of fluid rams 124 the opposite ends of which are pivotally supported on frame 10.

Rigid member 120 also has a second generally vertical plate 130 mounted on the forward portion of plate 121 through a spacer 132 and one end of a tilt fluid ram 134 is pivoted by a pin 136 between the upper ends of plates 121 and 130. Rigid member 120 including plates 121 and 130 has a circular opening 140 aligned with the longitudinal center line for the vehicle and a mounting pin 142 is fixedly secured to the vertical plate 76 and is received into opening 140. A further pin 144 is located adjacent one outer end of mounting frame 12 which receives a sleeve 146 mounted on the piston rod of fluid ram 134.

With the structure disclosed in FIG. 3, simultaneous extension of both fluid rams 124 will lower rigid link 110, mounting frame 12 and blade 16 as a unit while retraction of fluid rams 124 simultaneously will raise the entire structure. To tilt the blade 16, fluid ram 134 is extended or retracted to change the angular orientation of mounting frame 12 and blade 16 as a unit with respect to rigid link 110. Of course, if desired, a single fluid ram could be substituted for the pair of fluid rams 124 thereby reducing the cost of the overall unit.

As can be appreciated from the above description, in both embodiments of the invention, raising, lowering and tilting of the blade can be accomplished through the use of only a pair of fluid rams and an extremely simplified mounting structure consisting of conventional parts. With this arrangement, the cost for mounting blade 16 is greater reduced while still having the desired versatility.

What is claimed is:

1. In a vehicle having an elongated vehicle frame with a dozer frame supported thereon and a dozer blade supported on said dozer frame, first and second transversely spaced rigid links, pivot means defining a universal connection for one end of each link on said vehicle frame and a universal connection for an opposite end of each link on said dozer frame, a third link extending generally parallel and spaced from said first and second links, said third link having one end pivoted on said vehicle frame and an opposite end supported by a universal connection on said dozer frame, first and second independently actuated fluid rams interposed between said vehicle frame and said dozer frame for raising and lowering said dozer frame and for tilting said dozer frame on said vehicle frame, motion limiting means pivoted on said vehicle frame and interposed between said rigid links for limiting transverse shifting of said dozer frame with respect to a longitudinal vehicle axis and cooperating with said rigid links for limiting the tilt of said dozer frame with respect to a horizontal reference plane.

2. In the vehicle as defined in claim 1, wherein said mounting frame includes at least three vertically spaced plates with first and second arm means having one end pivoted on said plates and an opposite end mounted for movement on said dozer blade and first and second cylinder and piston rod assemblies respectively connected to said first and second arm means, said first cylinder and piston rod assembly being interposed between a first pair of plates and extending generally transversely of said longitudinal vehicle axis and said second cylinder and piston rod assembly being interposed between a second pair of plates and extending generally transversely of said longitudinal vehicle axis.

3. In a vehicle having a dozer blade mounted thereon by a mounting means comprising:

(a) a mounting frame;

(b) arm means between said mounting frame and said dozer blade;

(c) moving means for moving said arm means to shift said dozer blade relative to said mounting frame;

(d) first and second transversely spaced links, each link having one end joined to said vehicle by a universal connection and the opposite end joined to said mounting frame by a universal connection;

(e) a third link, said third link having one end pivoted to said vehicle and having its opposite end joined to said mounting frame by a universal connection;

(f) fluid ram means for pivoting said links to raise and lower said mounting frame and said dozer blade as a unit and for tilting said blade and mounting frame as a unit with respect to a horizontal reference plane; and (g) limiting means, carried by said vehicle and interposed between said first and second links, for limiting the amount of tilt of said mounting frame and said dozer blade with respect to said horizontal reference plane and for limiting the transverse shifting of said links with respect to said vehicle.

4. The mounting means defined in claim 3, in which said limiting means includes a limiting frame pivoted on said vehicle and interposed between said first and second links, said limiting frame spanning the major portion of the areas between said first and second links to limit the transverse shifting of said links with respect to said vehicle.

5. The mounting means defined in claim 4, in which said limiting frame has motion control members interposed in the path of movement of said first and second links to limit the amount of tilt of said mounting frame and said dozer blade with respect to said horizontal reference plane.

6. The mounting means defined in claim 5, in which said motion control members include first and second C-shaped members having legs extending from said limiting frame above and below said first and second links.

* * * * *